United States Patent [19]

Zielke

[11] Patent Number: 4,594,837

[45] Date of Patent: Jun. 17, 1986

[54] CASSETTE PACKING DEVICE AND METHOD

[76] Inventor: Darrell W. Zielke, 25526 Via Desca, Valencia, Calif. 91355

[21] Appl. No.: 729,310

[22] Filed: May 1, 1985

[51] Int. Cl.[4] ..... B65B 43/38; B65B 7/26

[52] U.S. Cl. ..... 53/468; 53/250; 53/252; 53/377; 53/381 R

[58] Field of Search ..... 53/468, 492, 564, 566, 53/250, 252, 258, 377, 381 R, 381 A

[56] References Cited

U.S. PATENT DOCUMENTS

| | | | |
|---|---|---|---|
| 2,653,745 | 9/1953 | Huntar et al. | 53/377 |
| 3,050,915 | 8/1962 | Silverstolpe | 53/381 A X |
| 3,513,621 | 5/1970 | Chamberlin | 53/468 |
| 3,638,391 | 2/1972 | Fluck | 53/381 X |
| 4,468,914 | 9/1984 | Pestes | 53/381 A X |

*Primary Examiner*—Horace M. Culver
*Attorney, Agent, or Firm*—Lyon & Lyon

[57] ABSTRACT

A mechanism for loading cassettes into soft-poly boxes which employs a poly box hopper and a cassette hopper. Poly boxes are advanced one after another by a pusher from the poly box hopper to successive stations for opening the box lid, loading the cassette into the box, closing the box lid and restacking the loaded box, in seriatim. The poly boxes index each succeeding poly box along a guideway by a pusher which pushes the poly boxes end to end therealong. At the lid opener station, the box is clamped and the lid is forced upwardly and skewed so as to properly enter a guidepath as the box travels to the next station. The cassette loading station properly orients a cassette and forces it into the waiting box with proper indexing and a forceful biasing downward of the cassette into the box. At the lid closure station, the cassette is fully forced into the box and the lid is forcefully closed thereon. The box is then stacked upwardly from the bottom at the last station where the loaded boxes are periodically removed.

16 Claims, 17 Drawing Figures

10
12
14
16
40
42
44
46
48
50
52
54
60
70
72
74
76
78
80
82
84
86
88
90
92
94
96
98
100
102
108
110
112
114
116
118
130
132
134
138
140
152
160
162
220
224
226
4
5

CASSETTE PACKING DEVICE AND METHOD

BACKGROUND OF THE INVENTION

The field of the present invention is devices and methods for packing cassettes into boxes.

Consumer packaging of magnetic tape has come in recent years to be standardized in a plurality of holders including audio cassettes and three-quarter inch and one inch video cassettes. These cassettes are generally placed in boxes for protection that are intended to remain with the cassette except during playing. To a certain extent the boxes for such cassettes have also been standardized on a relatively few number of styles. One such style is known in the industry as the soft-poly box. This style box is generally made from impact resistant polymeric material and is somewhat flexible. These boxes are also generally made as one piece with a lid hinged along one edge of the box by means of a thin, and therefore highly flexible, integral strip. The lids on such boxes generally include a flange about the front and ends of the lid which extends downwardly toward the box and slightly outwardly thereof. Resilient teeth interlock the lid and the front of the box.

The soft-poly boxes are advantageous in that they are rugged and inexpensive. However, they also exhibit certain drawbacks. Principal among these is the lack of dimensional stability resulting chiefly from the highly flexible nature of the boxes made from the flexible material. The lack of strict dimensional control is of little or no import to the user. However, for the rapid filling of such boxes by a manufacturer, this problem becomes a major difficulty. The boxes are not as easy to hold, index, manipulate the lid, insert the cassette and close the lid as are the more rigid but less durable packaging styles. Difficulties include proper purchase on the lids to insure opening thereof, proper indexing of boxes for positioning to receive cassettes, proper positioning of cassettes within the boxes and proper closure of the lids.

The indexing of boxes is preferably accomplished by having each box push a preceeding box through a loading system. Where individual conveying grippers or stops are required for each box, the speed at which the machine operates is limited. When the items themselves are able to move and index the preceding item, additional speed may be achieved. However, with the soft-poly boxes, two widths exist. The lid is larger than the box itself. Even though this difference is not great, it is sufficient to disrupt indexing for accurate placement of a cassette. The lack of exact dimensional control adds to this difficulty.

Soft-poly boxes also can exhibit a curling of the box sides such that the sides of the box may interfere with the positive placement of a cassette therein. Thus, a force inserting the cassette toward the back of the box may be required as well as a force pushing down on the cassette at the front of the box.

In the handling of cassettes, several devices have been developed. A device for splicing and loading electromagnetic tape onto a cassette is disclosed in U.S. Pat. No. 3,848,825. This patent is incorparated herein by reference to illustrate the sequence of operation of splicing and loading. To further expedite the loading of cassettes, another device was developed which employs automatic threading once the cassette was placed on the spindles of the cassette loading device. This threading mechanism is disclosed in U.S. Pat. No. 4,216,052. The disclosure of this patent is also incorporated herein by reference to particularly illustrate a threading mechanism. A cassette handling device for removing cassettes from a stack, loading the cassettes on a threading machine and then stacking the loaded cassettes in a second pile was also developed. This device is disclosed in U.S. Pat. No. 4,415,301. A device for orienting cassettes which are stacked in alternating directions is disclosed therein. The disclosure of this patent is also incorporated herein by reference to illustrate such cassette handling.

SUMMARY OF THE INVENTION

The present invention pertains to apparatus and methods for loading cassettes into soft-poly boxes. Several aspects of the presents invention aid in the handling and loading of cassettes into such difficult packaging.

To index the soft-poly boxes without requiring individual indexing elements for each box, the boxes are positioned end to end in a guideway in accordance with a first aspect of the present invention. The lids of the boxes are then opened under controlled conditions such that the lids on adjacent boxes in the guideway are in continuous contact at least across a small area of the flange on each lid edge. In this way, indexing is not affected by the variation in length dimension between the lid and the box. This control of the lid position can also prevent the lid flanges from curling inward due to the aforementioned comparitive dimensional instability of the soft-poly box. Such curling could otherwise cause a lid flange to interfere with the side of a box upon closure.

Indexing is further accomplished by index clamps which have fingers capable of being positioned to either side of a box located in the cassette loading position. The fingers are sized to fit within the spaces between boxes created by the additional length of the lids.

In another aspect of the present invention, the detrimental flexibility of the soft-poly box lid is used advantageously to insure proper orientation of the lid as it proceeds along the guideway. To this end, a spring biases one portion of the lid downwardly while another portion is held in a raised position, in order that the lid will positively run along a guide into place.

Directed to the loading of cassettes into the soft-poly boxes, a further aspect of the present invention contemplates the employment of two lugs extending to a cassette on either side of the raised portion, or access port, of the standard cassette. These lugs also include bevel surfaces facing toward the soft-poly box. Thus, a pusher is provided to force a cassette into an open box with that cassette aligned between lugs and forced forwardly and downwardly into the open box. The controlled position of the lid may further help in the guidance of the cassette down into the box itself.

The final location of the cassette within the box may be accomplished according to a further aspect of the present invention at the time of closure of the lid on the box. Prior to closure of the lid, the cassette is to be placed far enough into the soft-poly box so that the trailing lower edge of the cassette is down below the rim of the box. In this position, the lid itself may force the cassette fully into the enclosed position as that lid is closed. Thus, a two action closure may be provided which first acts to force the cassette rearwardly in the box as far as possible as well as downwardly into the box. The lid is then sequentially closed and the loaded box is ready for stacking.

Accordingly, it is an object of the present invention to provide a cassette packing device and method useful for loading cassettes into soft-poly boxes. Other and further objects and advantages will appear hereinafter.

DETAILED DESCRIPTION OF THE PREFERRED EMBODIMENT

Figure 1:
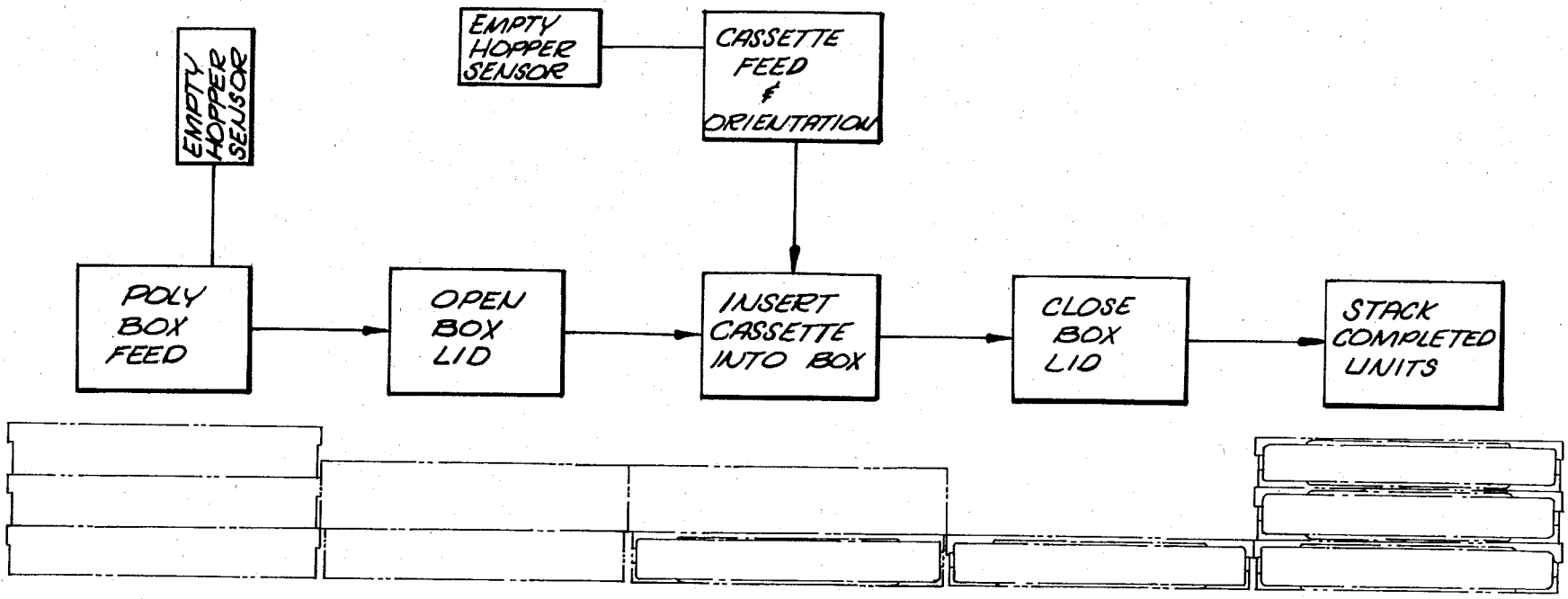
FIG. 1 is a process schematic of the present invention.

Turning in detail to the drawings, FIG. 1 illustrates a process schematic by which boxes and cassettes move through the preferred embodiment of the present invention. Soft-poly boxes are stacked at one end of the packing device. The boxes are preferably stacked as received from a supplier with the lids closed and each box oriented in the same direction. An empty hopper sensor recognizes a loss of supply for shutting down the equipment. To load a poly-box, the boxes are pushed to the station for opening the box lid. At this station, the box is gripped and openers force the box lid to disengage and pivot from the box. As will be further described, the lid is twisted to better feed into the next operation.

With the box lid open, the box is moved to the loading station such that the device can insert a cassette into the box. A cassette feed is employed which preferably takes cassettes as arranged during conventional handling with the cassettes alternating in orientation for better stacking. Naturally, cassettes oriented in the same direction may be employed in such a machine. Again, an empty hopper sensor provides for a shutdown of the equipment with the exhaustion of supply. From the loading position, the box with the cassette therein is directed to the position for closing the box lid. After this has been accomplished, the packed box is stacked with other completed units.

Figure 2:
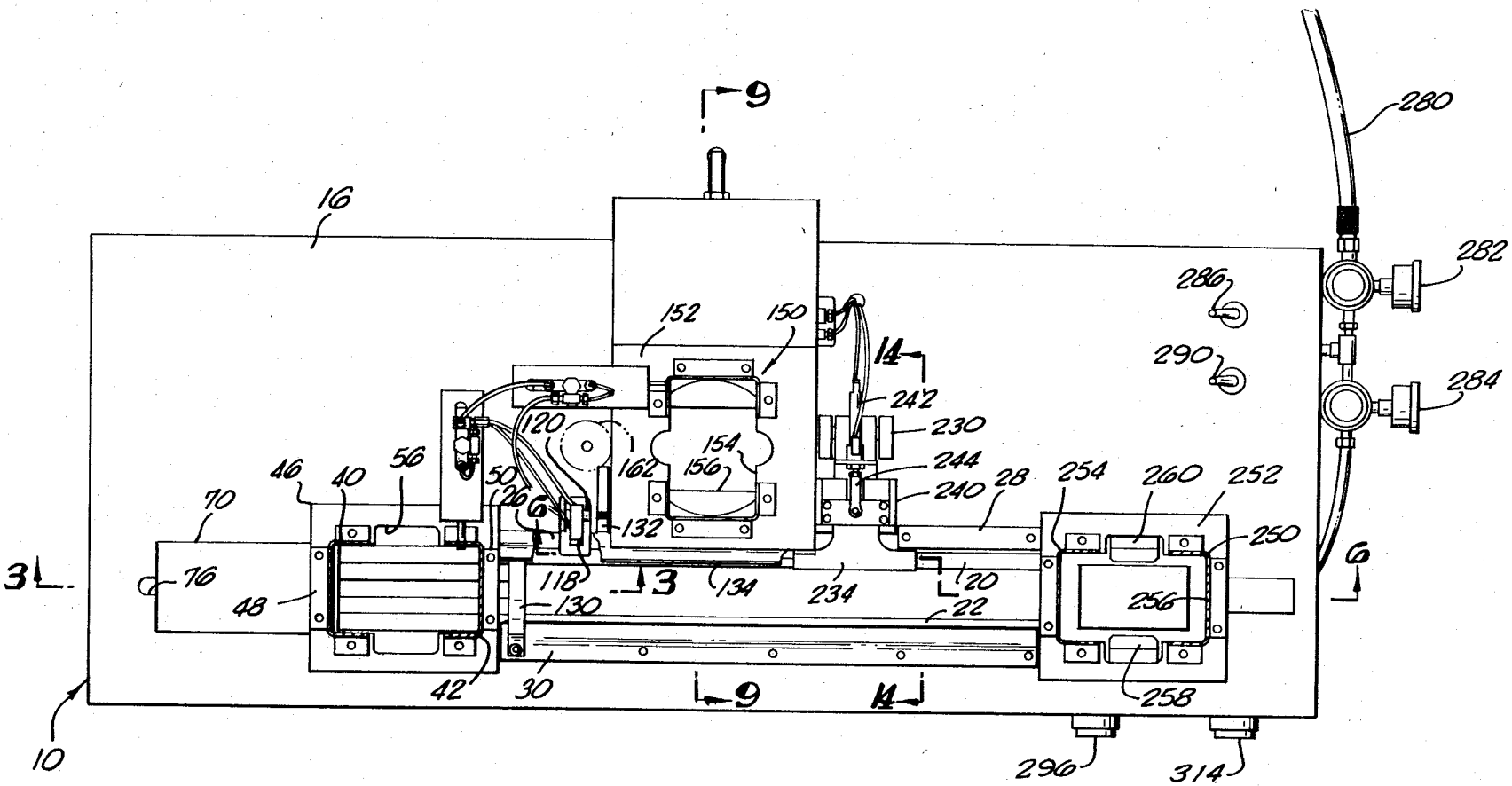
FIG. 2 is a plan view of a device of the present invention.

Looking then to the actual mechanism as seen in plan in FIG. 2, a supporting housing, generally designated 10, is employed to mount the mechanisms of the devise thereon. The pheumatic controls may be conveniently positioned within the housing 10. The construction of the housing 10 in this preferred embodiment includes conventional sheet metal walls 12 resting on pads 14 and supporting a mounting plate 16 as can best be seen in cross-section in FIG. 3.

Located centrally on the forward portion of the mounting plate 16 is a guideway. The guideway is defined by a plurality of elements and mechanisms and generally runs adjacent the surface of the mounting plate 16 from left to right as seen in FIG. 2. Two runners 20 and 22 provide a supporting surface for the travel of soft-poly boxes through the mechanism. One side of the guideway is generally defined by a rail 24. The other side of the guideway is defined by rail sections 26 and 28 and by the bodies of operational components as will be described hereinafter. Positioned on the rail 24 and extending over the guideway therefrom at an incline is an upper guide 30. Thus, a guideway is defined by the runners 20 and 22, rails 24, 26 and 28 and an upper guide 30 as well as the bodies of certain operational components. Naturally, the guideway is sized by these elements to accommodate the passage of soft-poly boxes positioned end to end there along.

Arranged to one end of the guideway, to the left as viewed in FIG. 2, is a soft-poly box feed mechanism. This mechanism is best illustrated in FIGS. 2 through 5. The mechanism includes a hopper or magazine not unlike that employed in U.S. Pat. No. 4,415,301 incorporated herein by reference, which was used for introducing cassettes. In the present case, the soft poly box feed mechanism receives a stack of soft-poly boxes and dispenses them one at a time to the guideway. The hopper includes a vertical magazine formed by two channels 40 and 42 which face one another to form a rectangular column. The channels 40 and 42 do not extend to meet one another in order that manual access to a stack of soft-poly boxes within the magazine is permitted at the upper end of the channels 40 and 42. Flared tabs 44 aid in the filling of the vertical magazine.

Figure 3:
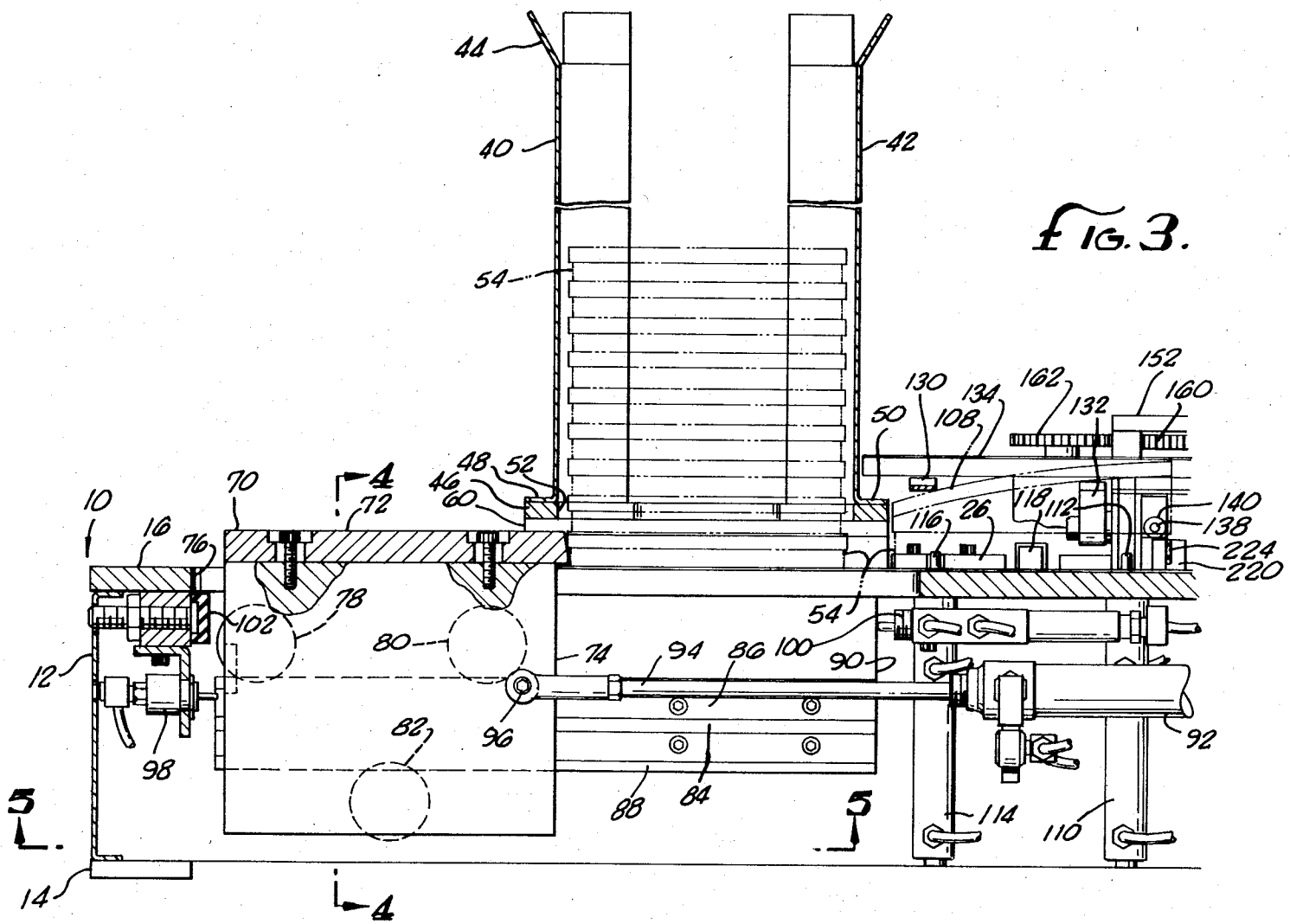
FIG. 3 is a cross-sectional elevation taken along line 3—3 of FIG. 2.

Beneath the channels 40 and 42 a guide plate 46 is positioned to support the channels 40 and 42 at attachment flanges 48 and 50 and to provide a port 52 through which the soft-poly boxes may pass downwardly from the vertical magazine into alignment with the guideway. The orientation of the soft-poly boxes in the feed mechanism is best seen in FIG. 3 where the soft poly boxes 54 are illustrated in phantom.

Figure 4:
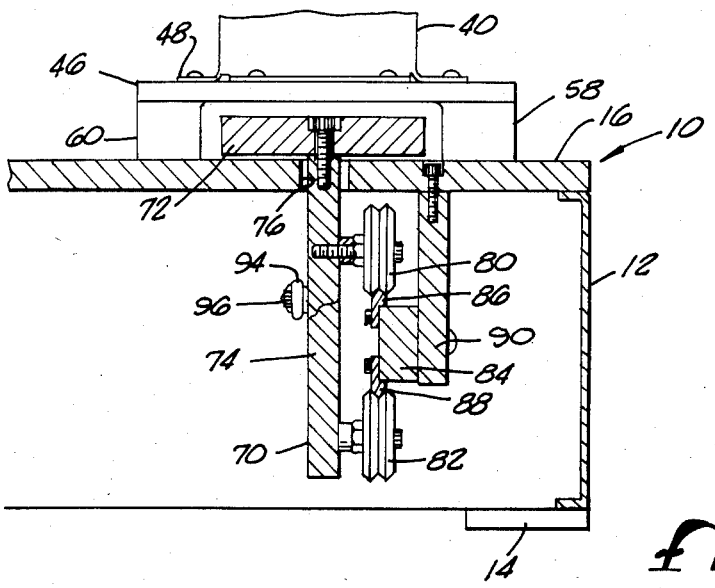
FIG. 4 is a cross-sectional elevation taken along line 4—4 of FIG. 3.
Figure 5:
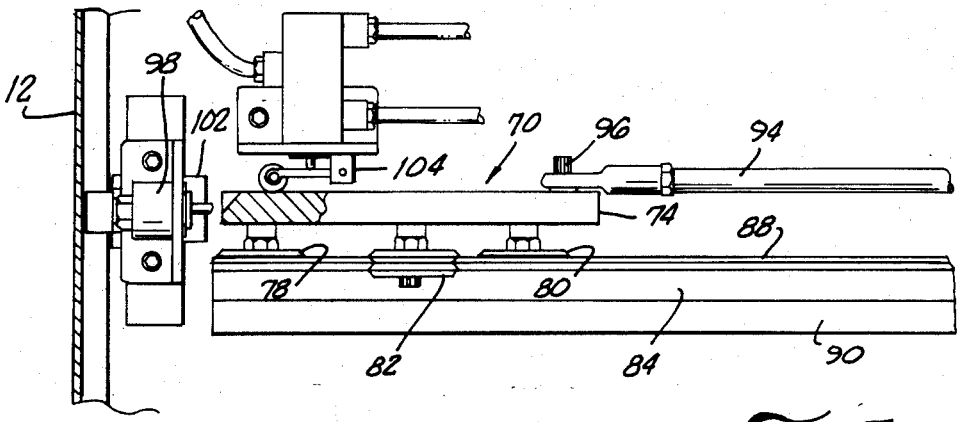
FIG. 5 is a cross-sectional bottom view taken along line 5—5 of FIG. 3.

The guide plate 46 includes access cavities 56 aligned with the spaces between the channels 40 and 42, providing increased manual access to the stack of poly boxes 54. The guide plate 46 is arranged such that it is spaced above the floor of the guideway a distance greater than the height of a soft-poly box 54. Again, this relationship can be seen in FIG. 3. Through this placement of the guide plate 46, a first poly box positioned on the guideway is free to slide beneath the guide plate 46. At the same time, the poly box immediately thereabove is laterally restrained by the port 52 to remain in the stack. To achieve this spacing, mounting blocks 58 and 60 are arranged to either side of the guideway to support the guide plate 46. As can be seen in FIG. 4, the mounting blocks 58 and 60 and the guide plate 46 form a passageway through which properly oriented soft-poly boxes 54 may be conveyed. With a stack of soft-poly boxes 54 arranged in the vertical magazine, the lowest box passes through the port 52 to become positioned between the mounting blocks 58 and 60 beneath the guide plate 46, in alignment with the guideway.

A pusher mechanism is positioned in alignment with the guideway such that the lowermost poly box may be forced to move along the guideway from the feed mechanism. The pusher mechanism is principally illustrated in FIGS. 3, 4 and 5 as including a pusher 70 having a head 72 positioned in alignment with the guideway and a base 74 which extends through a slot 76 in the mounting plate 16. The slot 76 extends in alignment with the guideway to accommodate a full stroke of the pusher. Mounted to the base 74 are three grooved wheels 78, 80 and 82. The grooved wheels 78, 80 and 82 are rotatably mounted to the base 74 in an arrangement as can best be seen in FIG. 3 to accommodate a support rail 84. The support rail 84 extends in the direction of the guideway and includes two tracks 86 and 88 fixed thereto for receipt of the grooved wheels 78, 80 and 82. The tracks 86 and 88 include surfaces which mate with the grooved wheels 78, 80 and 82 to define a controlled path along which the pusher 70 may travel. The support rail 84 is attached to the housing 10 by means of a supporting plate 90.

To drive the pusher 70 along the path defined by the tracks 86 and 88, a pneumatic cylinder 92, having a piston rod 94 is coupled by means of a threaded pin 96 to the base 74 of the pusher 70. To sense the location of the pusher 70 at the ends of its stroke, switches 98 and 100 are employed. The switches 98 and 100 are fixed relative to the housing 10 in the path of travel of the base 74. A resiliant block 102 is adjustably mounted to the housing 10 to ensure a limit to the travel of the pusher 70 as it retracts to permit positioning of another poly box 54. An additional sensor 104 also senses the position of the pusher 70, recognizing a change at mid-stroke.

In operation, the pusher mechanism retracts to the position illustrated in FIG. 3. The front surface of the pusher head 72 is configured to abut against a poly box 54 located beneath the hopper. The head 72 is sufficiently high to engage with one end of the poly box and at the same time miss the poly boxes stacked above the lowermost box to be pushed. The pusher 70 may then be stroked toward the guideway by the pneumatic cylinder 92 to force the lowermost poly box 54 into the guideway. The end of that stroke is carefully controlled to ensure that the box is properly indexed along the guideway. The pusher 70 may then retract to allow the next poly box 54 to fall into alignment with the guideway for another cycle of the mechanism.

Adjacent the pusher mechanism along the guideway is an opener station. The opener station includes an opener for pivoting the lids 108 of the poly boxes 54 from their received closed position. The opener includes a first vertical pneumatic cylinder 110 having a piston 112 which engages the forward edge of the poly box lid 108 and forces it upwardly to disengage the lid from the box itself and pivot the lid into an open position. The pneumatic cylinder 110 and piston 112 is positioned immediately adjacent the guideway so that the piston 112 may slide along the surface of the box 54 to catch the lid 108 in the upward stroke of the piston 112. A second pneumatic cylinder 114 and associated piston 116 engage a portion of the lid 108 spaced from the first cylinder 110. Those pneumatic cylinders 110 and 114 may act together to force the lid 108 upwardly into the open position.

Associated with the opener at the opener station is a pivotally mounted clamp 118. This clamp 118 is also positioned adjacent the guideway between the pneumatic cylinders 110 and 114 and is mounted on a shaft 120 which is pivotally borne by the housing in bearing supports 122 and 124. By means of a lever 126, the shaft 120 may be timely rotated to extend the clamp 118 into the guideway. The clamp face 128, which preferably has a resilient gripping surface, may thus grip the side of a poly box 54 positioned at the opener station to retain the box 54 in place as the pistons 112 and 116 drive upwardly to open the poly box lid 108. The clamp 118 employs the rail 24 as the opposed clamping surface in retaining the poly box 54 located at that station.

Also located at the opener station is a spring element 130. The spring element 130 extends to above the guideway and below the level to which the pistons 112 and 116 force the lid 108. During actuation of the opener, the piston 116 forces the lid 108 upwardly to encounter the spring element 130. The spring element 130 is then deflected with the lid 108 in an upwardly direction until the pistons are retracted.

Spaced from the spring element 130 at the opener station is a pawl 132. This pawl 132 also extends into the path of travel of the lid 108 at the opener station and is adjacent the piston 112. The pawl 132 is pivotally mounted relative to the guideway and includes a spring to bias the pawl into interference with the path of travel of the lid. Thus, as the lid 108 is raised by the piston 112, the pawl 132 is pivoted out of the way. Once the lid 108 passes the pawl 132, the pawl again returns to prevent retraction of the lid.

Located above the guideway at the opener station so as to provide a terminus to the path of travel of the lid 108 at that station is a lid guide 134. The lid guide 134 is best illustrated in cross-section in FIG. 8 as a plate member extending outwardly over the guideway and inclined upwardly therefrom. The full extent of the path of travel of the lid 108 is also illustrated in phantom in FIG. 8 as retained between the lid guide 134 and the pawl 132.

By virtue of the foregoing arrangement, the spring element 130, the pawl 132, and the lid guide 134 define an orientation for lids 108 when rotated to their open position at the opener station. This position of an opened lid 108 is best illustrated in FIG. 3 in phantom where it is shown that the lid 108 is skewed or twisted by the effect of the spring element 130 to ensure that the end of the lid most distant from the spring element 130 is biased upwardly against the lid guide 134. As the lid guide 134 extends across the full length of the opener station and beyond, there is no difficulty in moving the open lid 108 along the guideway with the lid biased against the surface of the lid guide 134. As the poly box 54 moves under the influence of the pusher 70 from the opener station, a lower lid guide 136 is encountered. This lid guide is best illustrated in side elevation in FIG. 7 as constituting a plate extending outwardly to above the guideway and angled downwardly away from the upper lid guide 134 to form a guidepath therewith. By biasing or skewing the lid 108 against the upper lid guide 134, the lower lid guide 136 may be encountered by the advancing poly box lid 108 without touching thereon.

Figure 6:
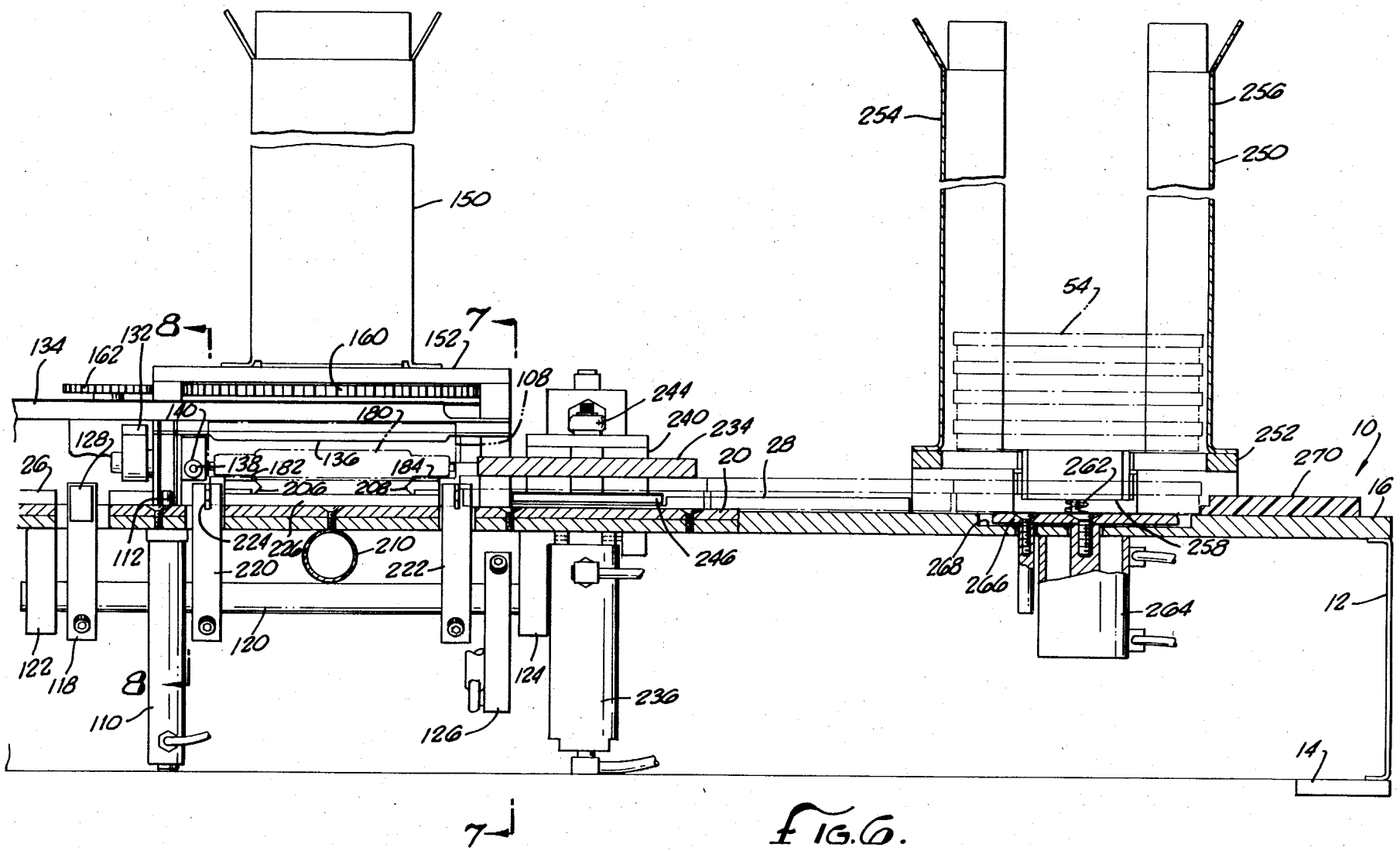
FIG. 6 is a cross-sectional elevation taken along line 6—6 of FIG. 2.
Figure 8:
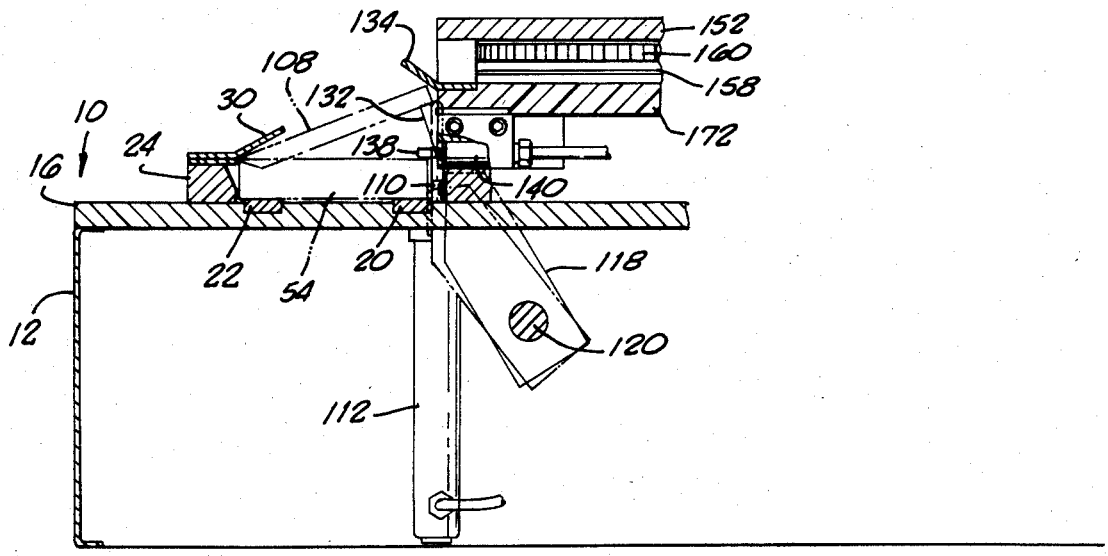
FIG. 8 is a cross-sectional elevation taken along line 8—8 of FIG. 6.
Figure 9:
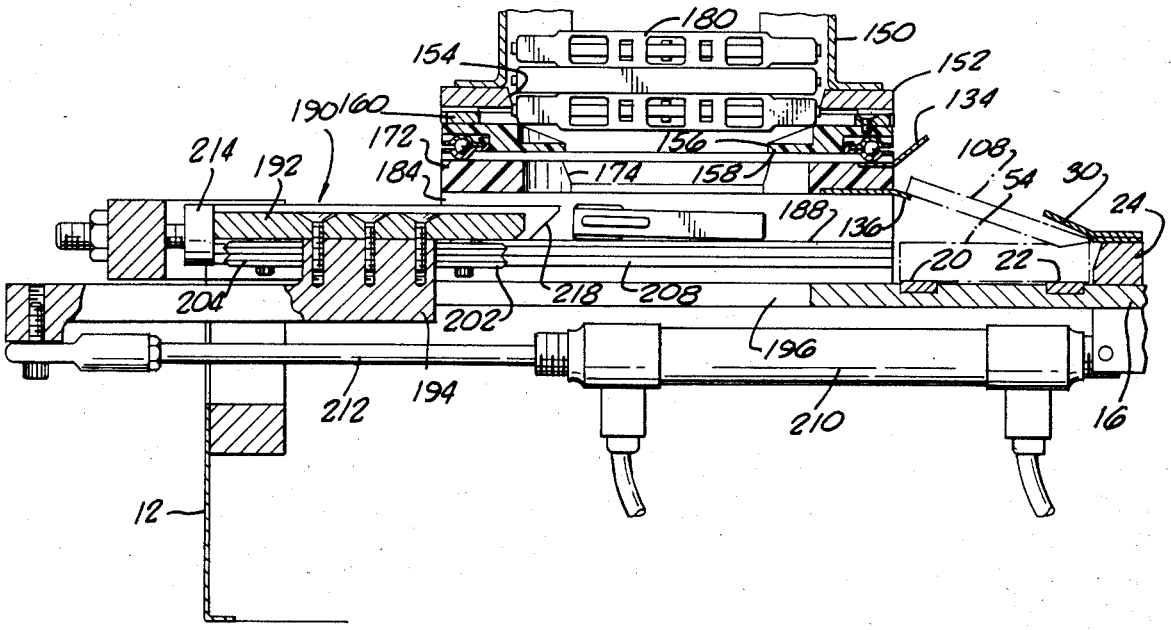
FIG. 9 is a cross-sectional elevation taken along line 9—9 of FIG. 2.
Figure 10:
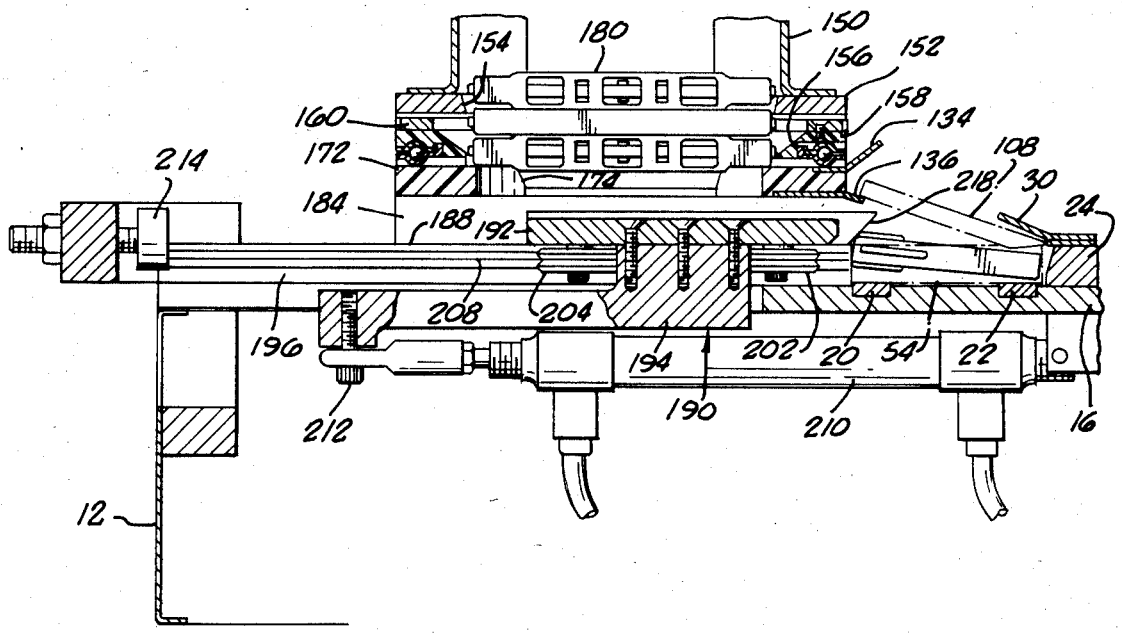
FIG. 10 is a cross-sectional elevation taken along line 9—9 of FIG. 2 with the mechanism advanced in sequence from that of FIG. 9.
Figure 11:
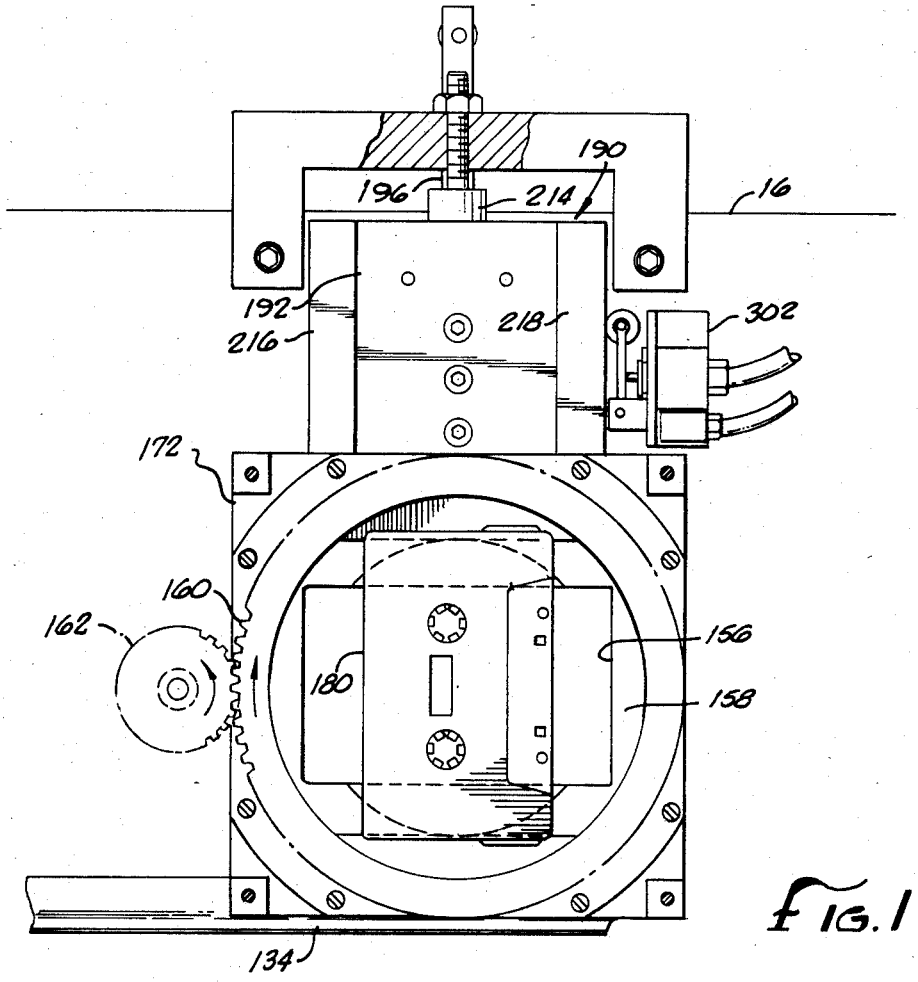
FIG. 11 is a plan view of the cassette dispensing device.
Figure 12:
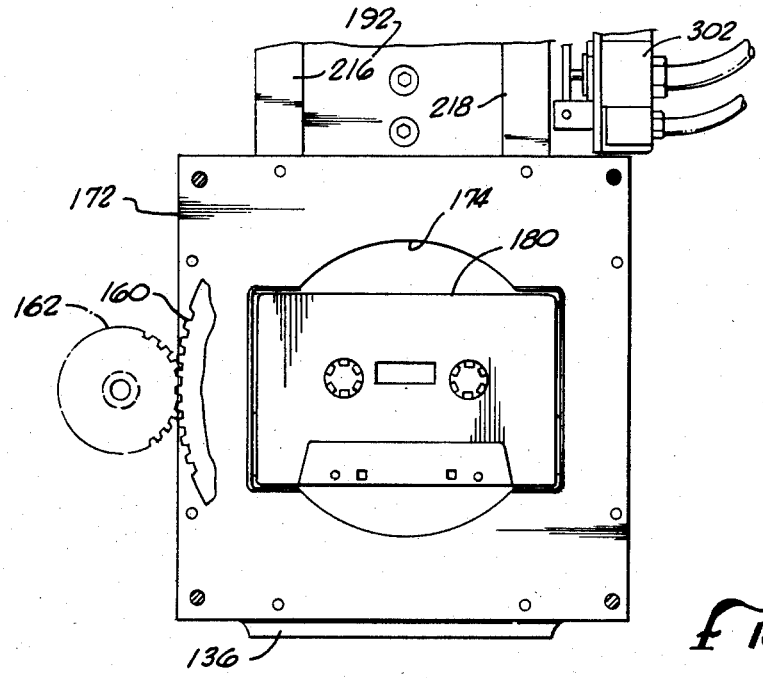
FIG. 12 is a cross-sectional plan view of the cassette dispensing device taken below the view of FIG. 11.
Figure 13:
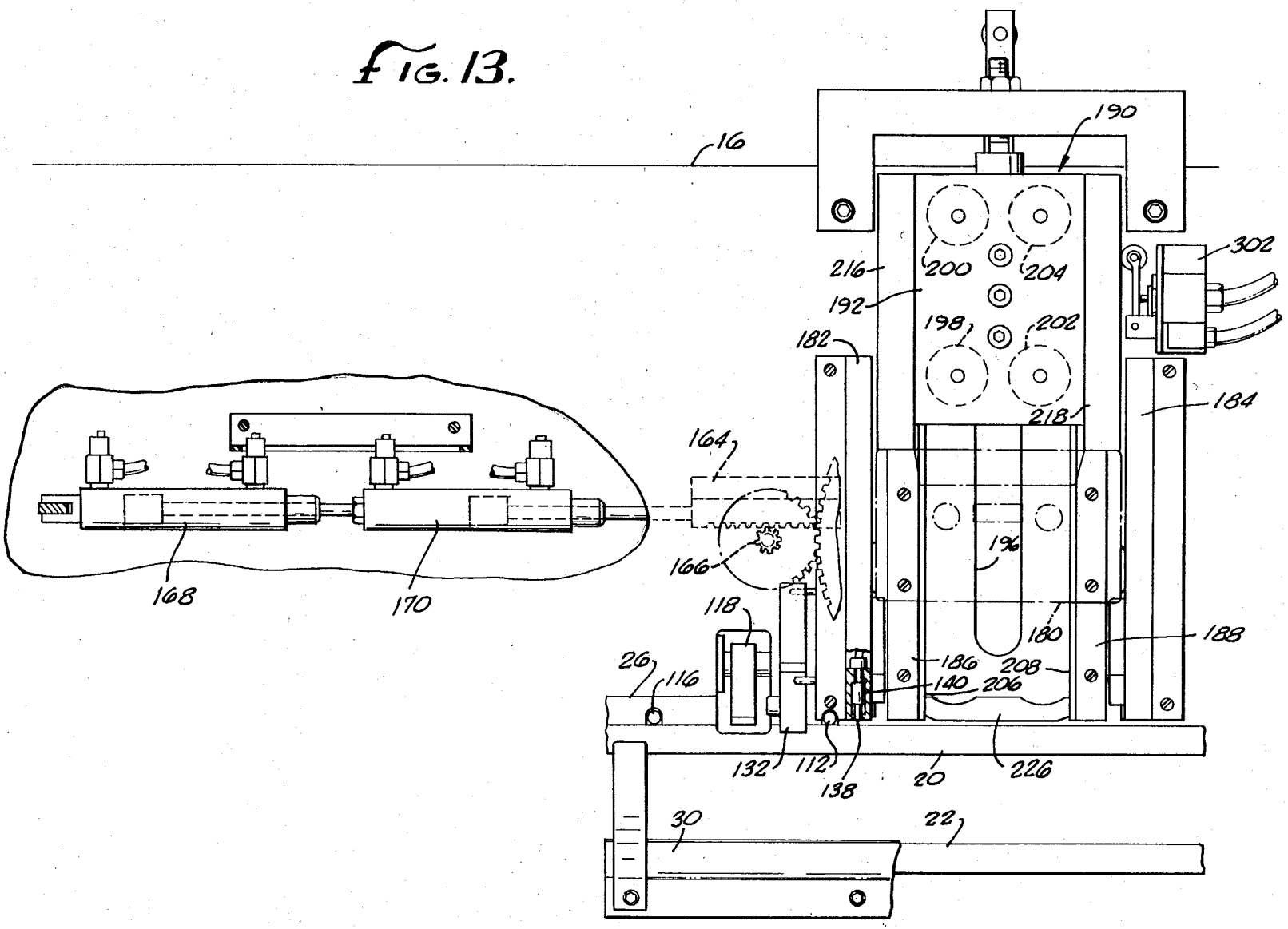
FIG. 13 is a plan view of the loading device with a portion broken away for clarity.

Adjacent the end of the opener station most distant from the pusher 70 is a pin 138 which is also pneumatically actuated in the preferred embodiment as part of a pneumatic cylinder 140. The pin 138 extends transversely to the guideway as can be seen in FIGS. 6 and 8 parallel to the plane of the guideway and at a location immediately above the top of an open poly box 54. The pin 138 thus retains the open poly box 54 in position during its advancement towards the next station. The pin is activated after the pistons 112 and 116 open the lid 108.

Along the guideway from the opener station is the cassette loading station where cassettes are loaded into the soft-poly boxes. The mechanism associated with this station is illustrated in detail in FIGS. 6 through 13. The cassette feed mechanism associated with the cassette loading station for presenting cassettes to a pusher for loading into the poly boxes is substantially that disclosed in U.S. Pat. No. 4,415,301 as the input mechanism for that system. Cassettes are normally arranged such that they alternate in the orientation of the access port of the cassette. The access port of the cassette is thicker than the storage portion of the cassette and alternate orientation of the cassettes allows them to be stacked vertically. Naturally, means are available for handling cassettes which are all oriented in the same direction. A brief description of the cassette feed mechanism employed to present individual cassettes to the pusher for loading into the soft-poly boxes will be set forth here for completeness. However, reference is specifically made to U.S. Pat. No. 4,415,301 for a more detailed explanation and discussion of this mechanism.

A cassette hopper 150 is arranged on top of a guide plate 152. The guide plate 152 includes a port 154 therethrough for passage of the cassettes. The port is dimensioned such that the cassettes positioned within the port cannot rotate. Immediately below the port 154 is a gate 156 defined in a rotatable plate 158. The rotatable plate 158 includes a gear 160 about the periphery thereof. The gear is driven by a gearwheel 162 which is in turn driven by a rack 164 and pinion 166. The rack is controlled by pneumatic cylinders 168 and 170.

Through this gear train, the pneumatic cylinders 168 and 170 control the orientation of the gate 156 in the plate 158. The port 154 and hopper 150 are arranged such that the cassettes have their longest dimension perpendicular to the longitudinal direction of the guideway. The gate 156 has a central position which is arranged such that a cassette therein has its longest dimension parallel to the guideway. The gate may then rotate by 90° in either direction to appropriately receive the next cassette as it may then pass through the port 154 into the gate 156. The gate 156 may then return such that the cassette is oriented with its longest dimension parallel to the guideway and with the access port thereof facing away from the guideway. A second guide plate 172 is located below the plate 158. This guide plate 172 also has a port 174. This port 174 is aligned with the gate 156 when the gate 156 is in its central position. Thus, any cassette which has been received by the gate 156 is allowed to drop through the port 174 as the gate 156 returns to its central position. Through an appropriate selection of the spacing between guide plates 152 and 172, one cassette may be received by the gate 156, reoriented and passed through the lower port 174 while the remaining cassettes in the hopper 150 are restrained from falling through the gate.

Below the hopper mechanism 150, a cassette guideway is provided for receipt of an individual cassette 180 received through the port 174. This cassette guideway is defined between two rails and 182 and 184. These rails 182 and 184 are spaced appropriately to receive a cassette 180 positioned with its longest dimension extending between the rails. The rails prevent skewing of the cassette 180 located within the cassette guideway. Runners 186 and 188 provide a sliding surface upon which the cassette 180 rests as it moves between the rails 182 and 184. Naturally, the guide plate 172 is located high enough above the runners 186 and 188 such that a cassette 180 positioned there between may move freely through the cassette guideway.

The cassette loading station includes a pusher mechanism for advancing a cassette 180 located within the cassette guideway to and into a soft-poly box 54 located in the main guideway. The pusher mechanism includes a pusher 190 employing similar construction features to the pusher mechanism for the soft-poly boxes. A pusher head 192 rides on the runners 186 and 188 while a base 194 extends through a slot 196 for engagement within a track and actuation by a pneumatic cylinder. The pusher 190 includes four grooved wheels 198, 200, 202 and 204. These wheels cooperate with tracks 206 and 208. A pneumatic cylinder 210 is coupled with the base 194 by a threaded pin 212, as can best be seen in FIGS. 9 and 10. The stroke of the pneumatic cylinder 210 and the attached pusher 190 is also illustrates in these two Figures. A soft bumper 214 is adjustably fixed relative to the housing to limit the stroke of the mechanism.

The head 192 of the pusher 190 includes two lugs 216 and 218. The lugs 216 and 218 extend forwardly of the main body of the head 192 and are spaced apart so as to receive the raised portion of the access port on each cassette 180 between the lugs 216 and 218. This spacing helps to guide the cassette in its travel through the cassette guideway into the soft-poly box 54 located in the main guideway of the mechanism. Additionally, the lugs 216 and 218 have a bevel on the front surface thereof such that the surface of each of the lugs 216 and 218 faces toward the main guideway. This arrangement can be seen in the side view of the lug 218 in FIGS. 9 and 10. The bevelled surface thus directs the cassette 180 both forwardly through the cassette guideway and downwardly as it passes beyond the guideway. Additionally, the cassette 180 is less able to twist upwardly and over the top of the pusher 190 if some resistance is met upon encountering the waiting soft-poly box 54.

At the pusher station on the main guideway, a soft-poly box 54 is indexed to receive the cassette 180 as it travels from the cassette guideway. The lower lid guide 136 cooperates with the upper lid guide 134 to retain the lid 108 of the soft-poly box 54 open to accept the cassette 180. The upper guide 30 also helps to maintain the position of the soft-poly box 54 in cooperation with the rail 24 to ensure location of the box. The lid 108 of the box 54 can thus act to help guide the incoming cassette down into the box proper.

Also located at the station are two index clamps 220 and 222. The index clamps 220 and 222 are fixed to the shaft 120 such that they may be actuated to move into the main guideway as required. The index clamps 220 and 222 each include a finger 224 located so as to extend into the guideway as the index clamps 220 and 222 are rotated in that direction. The fingers 224 are spaced apart such that a soft-poly box 54 may fit between the fingers 224 when properly arranged relative to the cassette loading station. The fingers 224 are also no wider than twice the thickness of the flange on a box lid 108. Thus, the fingers 224 are able to fit between two adjacent boxes 54 which have their lids 108 in abutting arrangement. The fingers 224 and the index clamps 220 and 222 further insure the proper location and retention of a soft-poly box while a cassette 180 is being loaded therein. Resiliently extending into the guideway is a plate 142 at the loading station. The plate 142 is positioned beneath the cassette guideway between the index clamps 220 and 222 and is spring loaded by two coil springs toward the main guideway. The plate 226 provides resistence to the free movement of boxes 54 along the main guideway in order that the boxes will not move by inertia beyond the positions of proper index provided by the pusher 70. The plate 226 also helps to properly locate the boxes at the cassette loading station. The plate 226 is also beveled to avoid catching on box corners as they move along the main guideway.

Along the guideway from the cassette loading station is a lid closing station. The lid closing station is best illustrated in FIG. 6 and in FIGS. 14, 15 and 16. As can be seen in the sequential FIGS. 14–16, the cassette 180 is fully positioned within the soft-poly box 54 and the lid 108 is firmly closed for later restacking. To accomplish this result, a closure device exhibiting a two degree of freedom motion has been found most advantageous.

Figure 14:
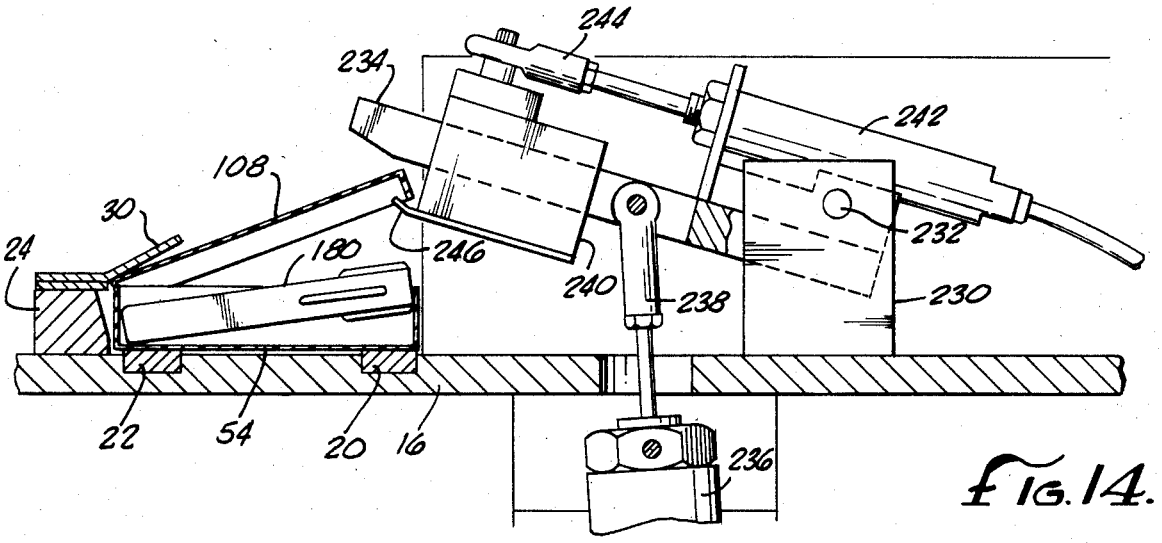
FIG. 14 is a cross-sectional elevation taken along line 14—14 of FIG. 2.
Figure 15:
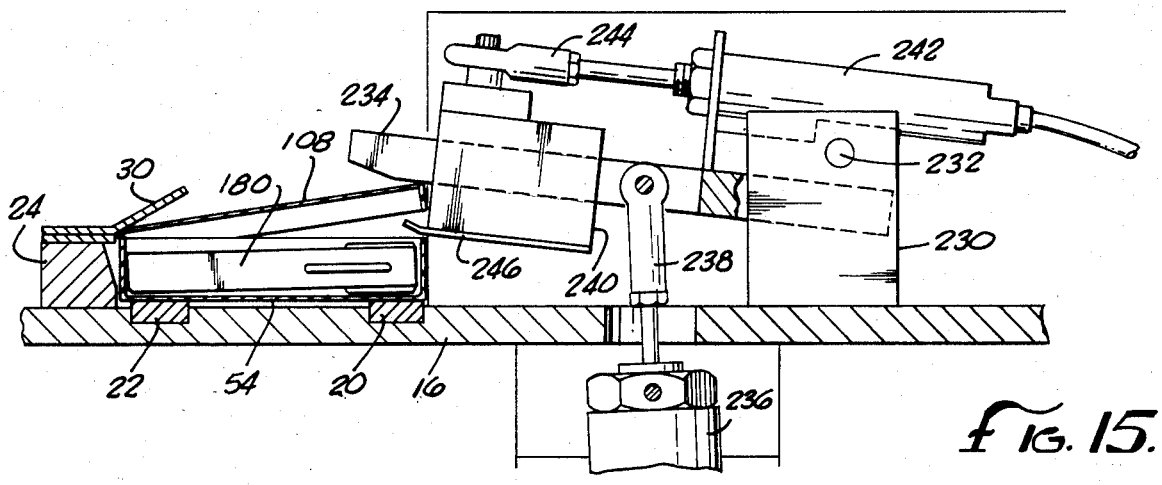
FIG. 15 is a cross-sectional elevation taken along line 14—14 of FIG. 2 with the mechanism advanced in sequence to that of FIG. 14.
Figure 16:
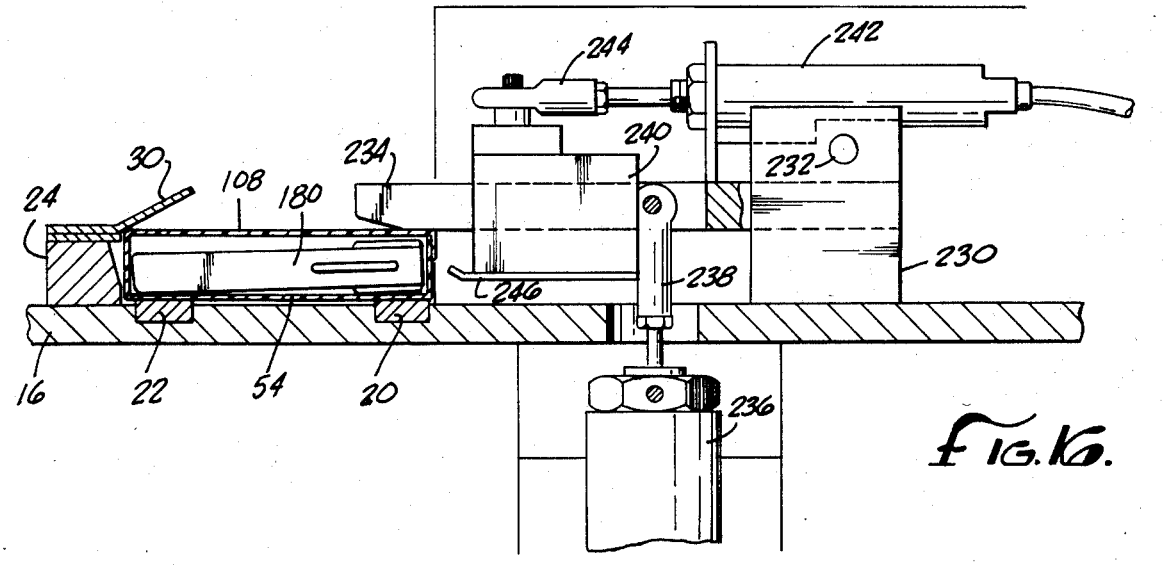
FIG. 16 is a cross-sectional elevation taken along line 14—14 of FIG. 2 with th mechanism further advanced in sequence.

The closure device includes a bearing mount 230 which is fixed to the mounting plate 16 of the device. The bearing mount 230 supports a bearing pin 232 to which a closure bar 234 is pivotally fixed. The closure bar 234 extends to the guideway and may be pivoted up and down over the guideway. A pneumatic cylinder 236 by an associated piston 238 is coupled with the closure bar 234 to effect the vertical movement thereof. From its extreme upper position, the closure bar 234 may extend above an open box 54. As the bar descends, it encounters the lid 108 of the box and eventually forces it closed at the end of the travel of the closure bar 234. This action is illustrated in FIGS. 14–16.

Positioned on the closure bar 234 is a sliding block 240. Also positioned on the closure bar 234 is a pneumatic cylinder 242 and associated piston 244. The piston 244 is coupled with the sliding block 240 such that the sliding block may be controlled to move forwardly or rearwardly on the closure bar 234. The sliding block 240 includes a shoe 246 which is spaced below the closure bar 234 by a sufficient amount to extend to underneath the open lid 108 as a soft-poly box is transported in the guideway from the cassette loading station to the lid closing station.

As the closure bar 234 is brought downwardly to begin the closure of the poly box lid 108, the shoe 246 moves downwardly to insure that the cassette 180, located within the soft-poly box 54, is pushed to the very back of the box such that the front edge of the cassette will clear the front wall of the box. The shoe 246 extends such that it will wipe across the front edge of the box with the downward pivot of the closure bar 234. At the point when the closure bar 234 is fully pivoted, see FIG. 16, the sliding block 240 is withdrawn by means of the pneumatic cylinder 242 to retract the shoe 246. This allows the closure bar to complete its return motion after closing the lid of the soft-poly box without the shoe 246 catching on the front flange of the lid 108.

Beyond the lid closing station, a leaf spring (not shown) is fixed to the rail 24 to provide some resistence to the motion of boxes along the guideway. This spring insures that boxes will not slide prematurely into the next station.

Further along the main guideway of the mechanism is a stacking station. The stacking station is best illustrated in FIGS. 2 and 6. The stacking station includes a hopper 250 generally constructed like the hopper of the soft-poly box feed mechanism. A mounting plate 252 supports a vertical magazine of channels 254 and 256. Unlike the feed mechanism, the stacking station employs pivotally mounted pawls 258 and 260 biased by springs 262 into the hopper area immediately above the mounting plate 252. A pneumatic cylinder 264 with an associated piston 266 is positioned within the guideway in a recess 268. With a loaded soft-poly box 54 driven along the guideway to a stop 270, the piston 266 may then force the loaded box 54 upwardly into the hopper, past the pawls 258 and 260. Once the box is above the pawls 258 and 260, the pawls return to prevent the box from falling downwardly back into the guideway. The piston 266 is sized so as to clear the pawls 258 and 260 to return for receipt of the next poly box.

Figure 17:
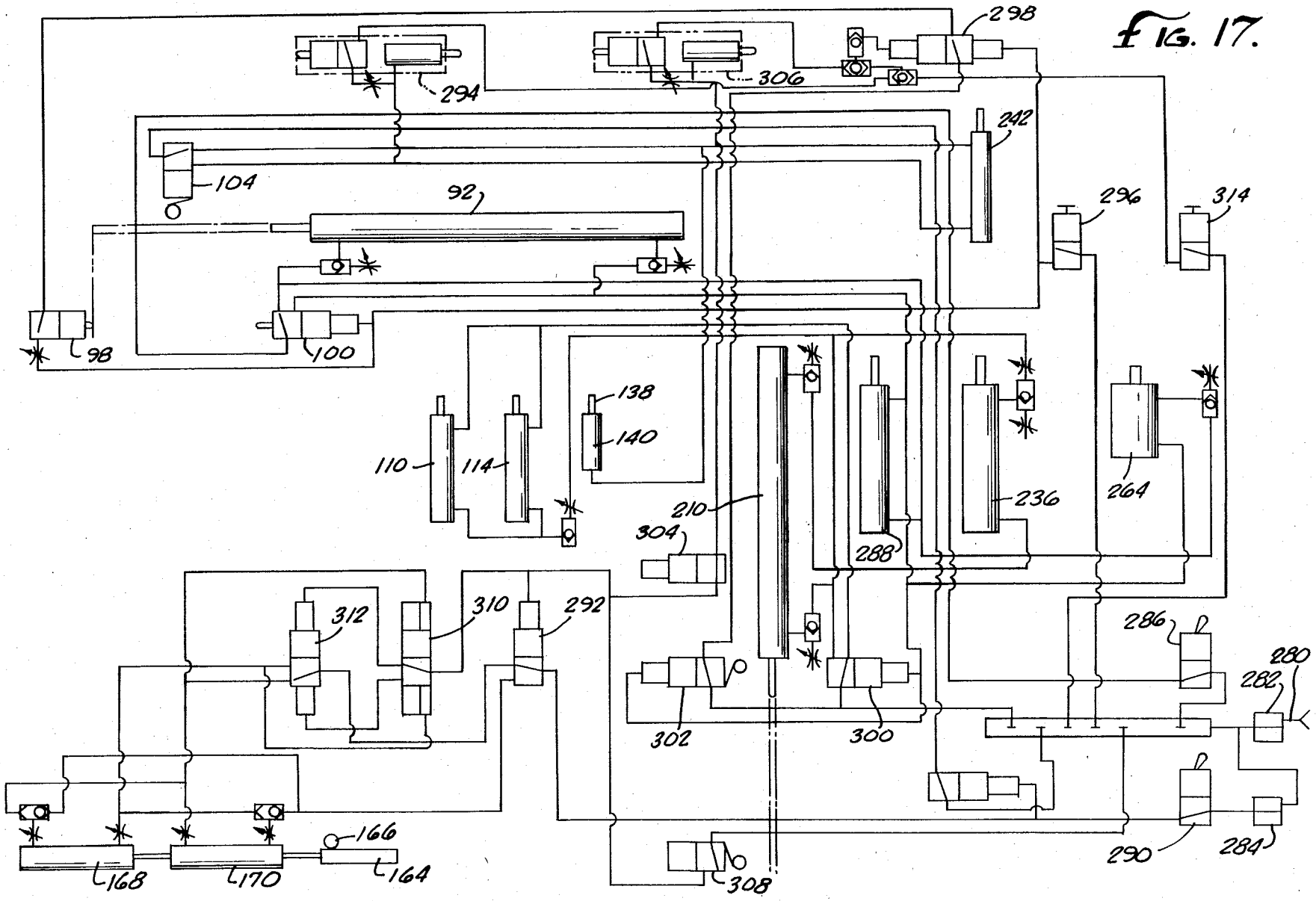
FIG. 17 is a schematic of the pneumatic system of the present invention.

Looking then to the operation of the device as controlled by the pneumatic system illustrated in FIG. 17, a source of pressurized air 280 provides pressure to the system through two regulators 282 and 284. A first toggle valve 286 controls the source of air to the pneumatic cylinder 92 associated with the poly box pusher mechanism. This toggle valve 286 also controls air pressure to a pneumatic cylinder 288 that in turn controls the shaft 120 for clamping and unclamping the poly boxes 54 located in the main guideway. The toggle switch 286 also controls the pneumatic cylinder 264 associated with the stacking assembly for the loaded poly boxes.

The toggle valve 290 controls supply air to a cassette orientor logic valve 292 which controls the direction of motion of pneumatic cylinders 168 and 170 for driving the rack 164 of the cassette orientor mechanism. This toggle valve 290 also controls air supply to a box level sensor system 294 and to the cylinder 140 having the pin 138 which extends out to retain the poly boxes 54 on the guideway during advancement.

A start button 296 when depressed provides a pulse of controlling air to a run valve 298 which sets the run valve 298 to the on position. The pulse from the start button 296 also resets the valve associated with the sensor 100 to start the poly box feed cylinder 92 from the home position extended against the sensor 98.

The sensor 104 having a cam valve is depressed for a portion of the stroke of the pneumatic cylinder 92 associated with the pusher mechanism so as to appropriately time a pulse to the pneumatic cylinder 140. The cam valve associated with the sensor 104 also controls the timing of the sensor 294 which checks the level of boxes in the feed hopper. Additionally, the sensor 104 also controls the timing of the pneumatic cylinder 242 associated with the shoe 246 to press the cassette 180 to the rear of the poly box 54 during the closing operation.

A valve 300 acts as a pilot controlled by the output of the sensor valve 100 during the return stroke of the pusher cylinder 92. This causes the cassette feed cylinder 210 to insert a cassette into the waiting poly box 54. The sensor 98 recognizing the extended position of the pusher cylinder 92 and a cam sensor 302 which recognizes the full stroke of the cassette pusher cylinder 210 is to be actuated before air is supplied through the run valve 298 to reset the sensor valve 100 such that the entire cycle may be repeated.

Coincident with the stroke and return of the pusher cylinder 92, the clamping cylinder 288 clamps the base of the boxes at the opener station and the cassette loading station. At the same time as the cassette pusher cylinder 210 is cycled, its control valve 300 also controls the opening of the box lid with the cylinders 110 and 114 and the closing of the loaded box with the cylinder 236.

A pulse valve 304 provides a momentary pulse to a sensor 306 which senses whether or not there are cassettes in the cassette hopper. If the cassette level is below the sensor, the sensor will open to allow the pulse from valve 304 to reach the shut off pilot of the run valve 298. Air for the pulse valve 304 is supplied by a cam valve 308 responsive to the cassette pusher cylinder 210 at its extended position. This same cam valve 308 also initiates a change in the cassette orientation logic by way of the valves 292, 310 and 312.

The cassette orientation is accomplished by the three-position gate 156. The center, or home, position is achieved by actuation of the logic control valve 292. Upon release of the valve 292, air through valve 312 acts to extend or retract both the cylinders 168 and 170 which cooperate to provide motion to the rack 164 and pinion 166 for orienting the gate 156. The alternate actuation of the cylinders is caused by operation of the binary trigger valve 310 as well as the four-way valve 312.

Depression of the stop button 314 sets the run valve 298 to its off position. The box pusher cylinder 92 travels to the home position against the limit valve 98 and stops. The cassette feed cylinder travels to the limit valve 302 and also stops.

In operation, a poly box 54 is released by retraction of the pusher 70 to the guideway. The pusher 70 then forces the poly box 54 to the opener station by means of a specific stroke length to index the box 54 to its first position. The clamp 118 extends out to retain the box in its position on the guideway. The index clamps 220 and 222 are also extended into the guideway with the clamp 118. The finger 224 on the index clamp 220 extends to adjacent the poly box 54 at the opener station with a portion of the clamp 220 engaging the poly box. At this time, the poly box 54 is indexed properly at the opener station and securely held in the guideway.

The pistons 112 and 116 then open the lid 108 and the pin 138 extends to hold the box 54 at the opener station from lifting upwardly from the guideway. Under the force of the pistons 112 and 116, the lid 108 moves upwardly past the pawl 132 to a position adjacent the upper lid guide 134. The lid 108 is thus captured between the pawl 132 and the upper lid guide 134. The pistons 112 and 116 are then retracted and the spring element 130 biases the lid 108 into a skewed orientation with one corner of the lid biased against the upper lid guide 134.

To ready the mechanism for the next cycle, the clamps 118 and 220 and the pusher 70 all retract. A second poly box 54 then is allowed to drop into the guideway behind the poly box 54 with the open lid 108. The pusher 70 is then advanced to force the second poly box 54 to the opener station. The operation as described above for opening the first poly box lid 108 is repeatedly performed on each succeeding poly box pushed to the opener station. As the pusher 70 advances the next poly box, the preceding poly box is advanced to the cassette loading station. The pin 138 cooperates with the guideway to insure the proper advancement of the first poly box such that it will not ride up out of the guideway. As the first poly box advances, the open lid encounters and rides over the lower lid guide 136 such that the lid is captured in the open position between the upper lid guide 134 and the lower lid guide 136. The spring element 130 has ensured that the lid is in the proper orientation to avoid the lower lid guide 136 as the lid advances past the nearest end of the guide.

Figure 7:
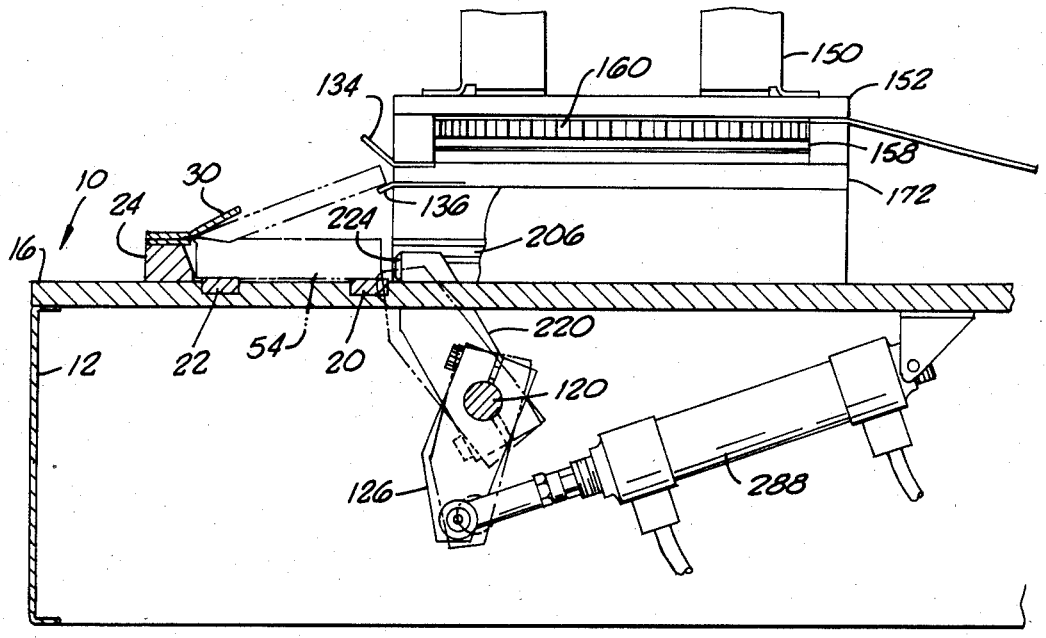
FIG. 7 is a cross-sectional elevation taken along line 7—7 of FIG. 6.

The lid on the first poly box 54 retained between the upper lid guide 134 and the lower lid guide 136 is maintained in a partially open position as may be seen in the Figures. This partially open position retains the flange on the side of the lid 108 of the first poly box 54 to continue to engage the flange on the succeeding poly box even prior to that box being opened. Thus, indexing is accomplished through the use of the poly boxes rather than by more complicated mechanisms. As also can be seen in FIGS. 7 and 8, the lid is retained from being opened to an extent which would allow the flanges on the poly box lid 108 to clear the sides of the box 54. Thus, the flanges are not afforded an opportunity to curl inwardly to interfere with the box upon lid closure.

With the poly box at the opener station, the clamps 220 and 222 extend into the guideway to engage the box in cooperation with the guideway. The fingers 224 insure proper indexing of the poly box. In this position, the poly box is properly indexed with the lid partially opened and retained for receipt of a cassette.

A cassette is provided to the cassette loading station from the hopper 150. The gate 156 is caused to rotate in the proper direction to receive a cassette and then rotate back such that the cassette falls into the cassette guideway. The cassette pusher 190 then forces the cassette toward the main guideway and into the waiting poly box. As the cassette encounters the poly box, it is guided into the box by the lid of the box. The lugs 216 and 218 extend to either side of the raised access port to help index the cassette relative to the box. The bevel on the pusher 190 also helps to force the cassette downwardly into the box.

With the retraction of the elements at the opener station, the clamps 220 and 222 retract as does the pusher 190. The poly box lid remains between the upper lid guide 134 and the lower lid guide 136. Furthermore, the lid flange continues to abut against the lid flange on the subsequent poly box.

The box pusher 70 then advances another poly box to repeat these same cycles. The leading poly box is likewise advanced by the succeeding boxes to the lid closing station. The lid closing station performs two functions: the completion of the placement of the cassette in the box and the closure of the lid. To receive the poly box lid, the closure bar 234 and the shoe 246 define a channel there between which is positioned in approximate alignment with the channel defined by the upper lid guide 134 and lower lid guide 136. Retention of the lid is best illustrated in FIG. 14. The closure bar 234 then moves downwardly to force the lid into the closed position. The shoe 246 also moves downwardly to force the cassette into its final position within the box. The shoe 246 then retracts to clear the box lid to complete the return motion for acceptance of the next poly box lid.

The pusher 70 then advances the train of poly boxes each to the next station. The leading poly box is forced to the stacking station along the guideway. The piston 266 is then activated to force the loaded box upwardly through the pawls 258 and 260 to a position within the hopper 250.

Once underway, the machine is simply replenished with poly boxes in the hopper of the feed mechanism and cassettes in the hopper 150. The loaded poly boxes are also periodically removed from the hopper 250. As discussed with attention to the pneumatics, a lack of boxes in the feed hopper or cassettes in the hopper 150 will shut off the machine. The stop button 270 may also be actuated to cease operation.

Thus, a mechanism for loading soft-poly boxes in a reliable and rapid manner has been disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A cassette packing device for loading cassettes into soft-poly boxes having a lid pivotally coupled to each box and flanges on each end of each lid extending toward the box and being outwardly therefrom, comprising a guideway sized to receive the soft-poly boxes end to end;

a pusher extending to said guideway to advance the soft-poly boxes along said guideway;

an opener to pivot the lids from engagement with the boxes; and a lid guide extending over said guideway at said opener to restrict pivotal movement of the lids such that flanges on adjacent lids remain in contact in said guideway.

2. The cassette packing device of claim 1 further comprising a clamp pivotally mounted relative to said guideway and selectively pivotable to engage a box in said guideway at said opener.

3. The cassette packing device of claim 1 further comprising a spring element extending to above said guideway and below the level of said lid guide and displaced from said opener along said guideway toward said pusher less than the length of a soft-poly box.

4. The cassette packing device of claim 3 further comprising a second lid guide spaced below said first lid guide to define a channel therewith for receipt of an edge of the lids pivoted from engagement with the boxes, said second lid guide being displaced along said guideway from said opener away from said pusher, and the end of said second lid guide most proximal said opener being displaced along said guideway from said spring element less than the length of a soft-poly box.

5. The cassette packing device of claim 1 further comprising two index clamps pivotally mounted relative to said guideway and selectively pivotable to engage a box in said guideway, said index clamps each having a finger extending toward said guideway, said fingers being mutually spaced the length of a soft-poly box, said index clamps being displaced along said guideway from said opener away from said pusher at a loading station, each finger being no wider than twice the thickness of a lid flange.

6. The cassette packing device of claim 1 wherein said opener includes a piston slidably disposed relative to said guideway to move in a perpendicular direction thereto to engage the lid of a soft-poly box.

7. The cassette packing device of claim 6 wherein said opener further includes a pawl extending into the path of travel of the lid of the soft-poly box actuated by said piston, said pawl being pivotally mounted relative to said guideway to rotate from the path of travel of the lid and having a spring biasing said pawl into the path of travel of the lid.

8. The cassette packing device of claim 1 further comprising a pin extending transversely of said guideway at a position elevated above said guideway to hold the boxes on the guideway, said pin being located along said guideway from said opener away from said pusher and including a pin actuator to actuate said pin after actuation of s id opener.

9. A method for packing cassettes into soft-poly boxes having a lid pivotally coupled to each box and flanges on each end of each lid extending toward the box and outwardly therefrom, comprising the steps of intermittently advancing boxes end to end along a guideway with each box pushing the preceding box;

gripping each successive box at an opening station;

raising the lid on the gripped box;

restricting the movement of the raised lid to insure that adjacent lids remain in contact with the raised lid;

filling each successive box with a lid raised at a filling station with a cassette;

closing a lid after filling the box.

10. The method of claim 9 further comprising the step of twisting the lid as the lid is raised to place one end of the lid higher than the other.

11. The method of claim 9 further comprising the step of positioning a guide pin over each successive box after raising the lid to hold the box on the guideway.

12. The method of claim 9 further comprising the step of positioning fingers to either side of each successive box at the filling station to index the box before filling.

13. A cassette packing device for loading cassettes into soft-poly boxes having a lid pivotally coupled to each box, comprising a guideway sized to receive the soft-poly boxes end to end;

a box pusher extending to said guideway to advance the boxes along said guideway;

a cassette track perpendicular to and above said guideway, sized to receive a cassette positioned transversely in said cassette track;

a cassette pusher extending to said cassette track to advance the cassettes toward said guideway, said cassette pusher having a pusher head having forwardly extending lugs to either side thereof, each having a bevel surface facing said guideway.

14. The cassette packing device of claim 13 wherein said lugs are spaced apart by the width of standard tape access ports on cassettes.

15. A cassette packing device for loading cassettes into soft-poly boxes having a lid pivotally coupled to each box, comprising a guideway sized to receive the soft-poly boxes;

a lid closure arm extending to above said guideway, said arm being pivotally mounted relative to said guideway and including a first actuator means for pivoting said arm toward the lid and box to engage the lid to the box;

a slidable member on said lid closure arm extending to above said guideway and having a bevel flange facing said guideway below said lid closure arm and second actuator means for retracting said slidable member along said arm, said bevel flange and said arm forming a channel for receipt of an edge of the lid.

16. A method for packing cassettes into soft-poly boxes having a lid pivotally coupled to each box, comprising the steps of intermittently advancing boxes end to end along a guideway;

gripping each successive box at an opening station;

raising the lid on the gripped box;

advancing a cassette toward each successive box below the raised lid at a filling station;

biasing the cassette into the box by means of the raised lid and a bevel surface facing the box pushing the cassette toward the box;

advancing the box past the filling station to a closing station;

pressing a bevel member down on the cassette in the box beneath the lid;

bringing an arm down on the lid at the closing station to engage the lid with the box, said engagement occurring after retraction of the member.

* * * * *